US006574889B2

(12) United States Patent
Cagner

(10) Patent No.: US 6,574,889 B2
(45) Date of Patent: Jun. 10, 2003

(54) FLEXIBLE SHOE SOLE

(76) Inventor: M. Bruce Cagner, 350 Fifth Ave., Ste. 729, New York, NY (US) 10118

( * ) Notice: Subject to any disclaimer, the term of this patent is extended or adjusted under 35 U.S.C. 154(b) by 81 days.

(21) Appl. No.: 09/781,649

(22) Filed: Feb. 12, 2001

(65) Prior Publication Data

US 2001/0016993 A1 Aug. 30, 2001

Related U.S. Application Data

(62) Division of application No. 09/474,481, filed on Dec. 29, 1999.

(51) Int. Cl.[7] ..... A43B 1/10
(52) U.S. Cl. ..... 36/102
(58) Field of Search ..... 36/102, 59 C, 36/59 R, 76 R, 148, 149

(56) References Cited

U.S. PATENT DOCUMENTS

| | | | | | |
|---|---|---|---|---|---|
| 339,953 | A | * | 4/1886 | Watkinson | 36/59 R |
| 1,106,000 | A | * | 8/1914 | Price | 36/148 |
| 1,813,235 | A | * | 7/1931 | Dunbar | 36/59 C |
| 2,155,166 | A | | 4/1939 | Kraft | |
| 2,162,912 | A | * | 6/1939 | Craver | 36/59 R |
| D163,960 | S | * | 7/1951 | Oakley | D2/951 |
| 3,704,474 | A | | 12/1972 | Winkler | |
| 3,708,815 | A | | 1/1973 | Jurasek et al. | |
| 3,913,160 | A | | 10/1975 | Funck | |
| 3,983,204 | A | | 9/1976 | Opinsky et al. | |
| 4,081,917 | A | | 4/1978 | Bradley et al. | |
| 4,170,802 | A | | 10/1979 | Roy | |
| 4,192,086 | A | | 3/1980 | Sichak | |
| 4,616,430 | A | | 10/1986 | McQuiggin | |
| D288,027 | S | | 2/1987 | Tonkel | |
| 4,658,514 | A | * | 4/1987 | Shin | 36/30 R |
| 4,703,533 | A | | 11/1987 | Barma | |
| 4,827,631 | A | | 5/1989 | Thornton | |
| 5,012,597 | A | * | 5/1991 | Thomasson | 36/59 C |
| 5,189,814 | A | | 3/1993 | Barma | |
| D378,318 | S | * | 3/1997 | James | D2/953 |
| 5,699,628 | A | * | 12/1997 | Boatwalla | 36/59 C |
| D414,922 | S | * | 10/1999 | Wright | D2/960 |
| D437,106 | S | * | 2/2001 | Cagner | D2/952 |
| D453,612 | S | * | 2/2002 | White | D2/949 |
| D453,989 | S | * | 3/2002 | Cagner | D2/959 |

FOREIGN PATENT DOCUMENTS

| | | | |
|---|---|---|---|
| EP | 560698 | * | 9/1993 |

* cited by examiner

*Primary Examiner*—Ted Kavanaugh
(74) *Attorney, Agent, or Firm*—William J Sapone; R. Neil Sudol; Henry D. Coleman

(57) ABSTRACT

A shoe comprises a flexible outersole, an insole and an upper, the upper being formed from a flat Thermo Plastic Rubber blank, a toe cap first being fabricated in the blank by means of a teacup crease special-use sewing machine, the blank or preform subsequently affixed to a last and joined by a second special purpose sewing machine, or disc feed overseaming machine, to a non-woven fabric midsole or insole, substantially completing the upper. Thermal processing on the resulting preform completes processing of the upper without use of an insole board. A third element of the shoe, the outersole, is unitary in construction, and equipped with a unique pattern of intersecting grooves, as well as an external bridge or instep support in lieu of an inner steel shank. Following bonding of the upper and the outersole, a shoe of unique flexibility is produced, while still providing adequate protection to an active user's foot.

13 Claims, 4 Drawing Sheets

FLEXIBLE SHOE SOLE

This application is a divisional of U.S. application Ser. No. 09/474,481 filed Dec. 29, 1999 still pending.

BACKGROUND

A price paid by humanity for an upright posture and for a habitat including supporting surfaces both painful and injurious to an unprotected human foot is the necessity of wearing footwear. Footwear protects the soles of a wearer's feet from the ground surface, the balance of a wearer's feet from other environmental influences, and simultaneously is viewed as a means of ornamentation and sexually differentiated display. In addition to protective and ornamental functions, requirements already partly in tension, an item of footwear is desired to do minimum violence to a user's pedal anatomy in the course of walking and standing, and simultaneously allow maximum possible freedom of movement so that the supple human foot may continue to function in a manner for which evolution adapted it, and possibly even move beyond the pedestrian in kinesthetic manifestation of physical talent. Simultaneously with an increasing flexibility in certain degrees or axes of motion however, as in bending in a posterior phalangeal or rearward toe or ball region, it may be desirable to reduce flexibility in other degrees of freedom, as in providing support or preventing collapse in a metatarsal region. The metatarsal region of a foot, or a corresponding region of a shoe, is also variously known as an arch or an instep region, with "instep" more indicative of a shoe, and "arch" more indicative of a foot.

Aforementioned manifold objectives of footwear function are of course partially in conflict, as may be observed from the marketing of ornamental or fashion shoes thought to be positively damaging to a user's feet, however accepted by a sub-population of shoe wearers as a necessary expression of a fashion persona. Similarly athletic shoes, while possibly making a fashion statement in a limited context, are unsuitable for dress or office wear. Other similar tradeoffs may be observed between comfort and protection, comfort and fashion, and so forth, not to mention between cost of manufacture and quality of materials and construction. Add to these trade-offs variation in user taste, fitness, mass, life-style, gait, activities and budget, and it is clear that a product which expands the envelope of available design solutions along at least one product axis is likely to increase some consumers' utility function, and hence constitute a new and useful addition to the foot-covering marketplace.

A demand exists for toddler's and children's footwear meeting a parent's need for fashionable decoration of the toddler, while simultaneously allowing that child freedom and comfort of pedal movement, while avoiding repetitive stress injury to the foot. Given a product meeting these objectives, an efficient or simplified method of manufacturing obviously possesses additional economic utility.

OBJECTS OF THE INVENTION

It is an object of this invention to provide an improved article of footwear.

It is a further object of this invention to provide an efficient method of manufacture for an improved article of footwear.

It is a more particular object of this invention to provide an improved article of footwear providing superior flexibility in a posterior phalangeal region.

Yet a more particular object of this invention is to provide an article with superior flexibility in a posterior phalangeal region, also possessing adequate support in a metatarsal or arch region.

Another object of the invention is to provide such an article of footwear embodying aesthetically pleasing features.

More particularly, an object of the invention is to provide an article of footwear having an construction functionally adapted to meet the above requirements, which article is also aesthetically pleasing.

Still another object of the present invention is to provide a method of construction for an article of footwear in accordance with the above object, which method is economically efficient.

These and other objects of the present invention will be more readily comprehended by an inspection of the drawings and specification contained herein.

SUMMARY OF THE INVENTION

A shoe is constructed having an upper, and a composite sole comprising an innersole, a midsole, and an outersole. An innersole is essentially an insert, either free-floating or affixed to an interior or upper surface of a midsole, and is not regarded as part of the present invention. The primary function of an innersole is generally to provide additional cushioning between a bottom of a user's foot and a remainder of the composite or multilayer sole, and, by variable thickness, more closely conform an innermost or upper surface of the composite sole with the bottom of the foot.

A midsole, unsurprisingly, is a structure intervening between an innersole and an outersole. In the present invention, a midsole is affixed to a lower periphery of the upper in a method of manufacture to be described more fully below. Finally, an outersole is affixed to a lower surface of the midsole as well as an exposed portion of the periphery of the upper. The outersole is that portion of the composite sole and of the shoe which directly contacts a ground surface during use, and is a relatively thick slab of rubberized plastic or other similarly flexible material, which by its bulk provides a dominant portion of a stiffness or elastic modulus of the shoe in bending and in twisting about major and minor principal axes; a lesser portion of the stiffness being provided by the upper. When confusion with "innersole" is not likely, the midsole may also be known as an insole.

The sole or outersole of a shoe functions to cushion the user's foot from small irregularities of a ground surface, such as pebbles, by distributing a resultant force concentration over a larger area of the bottom or sole of the user's foot, while ideally maintaining sufficient local flexibility and shock absorption to avoid pivoting or rocking on the irregularities. The (shoe) sole also provides an overall structural integrity to the shoe, and constitutes a strongest member thereof.

Structural and cushioning functions of the outersole dictate a relatively thick and rigid structure, compared to other components of the shoe. This relative thickness and rigidity are however counterindicated by a requirement or objective of flexibility. It is thus a general feature of shoe design, and a particular feature of the present invention, that an intelligent compromise be achieved between requisite rigidities, flexibilities and cushionings.

A useful compromise is achieved in part between rigidity, flexibility and cushioning in accordance with the present invention by an indentation or grooving of a foresole or frontmost portion of the outersole. Forming a grid-like pattern or design on a bottom or ground-contacting surface of the outersole, the indentations or grooves permit a greatest degree of flexibility in bending about a horizontal axis perpendicular to a longitudinal or major principal axis of a user's foot and shoe, a substantial degree of flexibility around this longitudinal axis, and simultaneously an incrementally negligible degree of flexibility about a vertical axis perpendicular to the longitudinal axis of the shoe or foot, thus preserving an overall shape of the shoe. Simultaneously a substantial degree of resistance to bending about a rearwardly parallelly displaced member of a series of horizontal axes perpendicular to the shoe's longitudinal axis, is achieved by interposition of a brace or bridge spanning a gap between a heel and the foresole, as will be clear in the illustrations. This bridge simultaneously provides added support to a user's metatarsal or arch region, while focussing bending about the described series of parallel axes in a region adjacent to a user's toes, coincident with a natural hinge region of the human foot. It is believed that a unique pattern of grooves or indentations in the foresole region of the outersole, coupled with the action of a uniquely adapted bridge or tapered shank support extending through the metatarsal or arch region of the outersole, cooperating with a conventional heel shape, confers a unique and advantageous combination of flexibility and stiffness against bending in variously rotated and spatially displaced axes of the outersole, and confers a uniquely advantageous complex mechanical characteristic on the shoe of which the outersole forms a composite member.

A further flexibility is achieved in a show built in accordance with the present invention by elimination or moderation of unnecessary sources of stiffness in a construction of the shoe. In particular, an internal steel shank support is replaced with the tapered external shank support or bridge, as discussed above. Also, an insole board, a common feature in the conventional shoe making art for, in part, maintaining a shape of an upper prior to attachment to an outersole portion of an item of footwear, is eliminated by virtue of a technique of construction which sews an upper blank directly onto a flexible non-woven fabric midsole, prior to a glueing of a resulting form to the outersole.

A process to fabricate an upper from a blank, and a midsole, comprises a plurality of steps: A special use sewing machine, known in the art as a "(toe) Cap Beat Crease" machine forms a toe shape in a blank prior to a lasting process, to create a partially formed upper, or first stage upper preform. The Toecap Beat Crease or Toecap Crease machine is known in the industry, and models are available from the Ta Chung sewing machine company, of Taiwan, R.O.C., and Yao Han Industries co., Ltd, also of Taiwan; Shin-Chuang City, Taipei Hsien.

Following a formation of the toe shape or toe cap, a second special use sewing machine, known in the art as a "Disc Feed Overseaming Machine" is utilized to stitch the preform directly to the non-woven fabric midsole. A resulting second-stage upper preform is then subjected to a 100 to 110 degree stress relief/vulcanizing heat treatment in order to remove a shape memory of an original flat blank conformation. The preform is subsequently subjected to a controlled and rapid cooling rate in order to impress a new stress-free conformation or shape memory on a now substantially prefabricated upper, or upper form. Upper and outersole are now bonded by adhesive over essentially a complete intermediate surface to form a uniquely flexible unitary construction without a use of insole board, insole binding, or other techniques known in the art of shoe construction tending to add additional stiffness.

Remaining machines mentioned: Vulcanizing machines, disc feed overseaming machines, and chillers or automatic refrigerators are known in the industry, and available on the open market.

DETAILED DESCRIPTION OF THE INVENTION

Since an inventive concept of the present invention depends upon a control of elastic properties of a component of an article of footwear, in particular, an outersole, through intelligent design of the component's shape, it will not be inappropriate to give a brief, qualitative, overview of aspects of solid elasticity or strength of materials which are especially relevant to this invention.

A modulus of elasticity, or stiffness, may be understood generically in an engineering sense as a stress, or force per unit area, divided by a strain, or displacement per unit length. This means qualitatively, that for a test piece of given dimensions and a given mode of deformation (such as bending), a stiffer material, i.e. one with a higher modulus, will require a greater amount of force to achieve a given deformation or bending, or, conversely, will bend or deform less for a given application of force than a less stiff material. Even given a simple elastomeric material, such as injection molded-rubber, it is still possible, and indeed, inevitable, to acquire non-directionally uniform elastic properties, or stiffnesses, in a finished article or component, based on a shape of the component. It will become clear through a consideration of the remaining specification and drawings that a novel design of an outersole of a shoe confers upon the outersole an advantageous set of elastic behaviors or moduli in response to forces encountered in use.

Figure 1A:
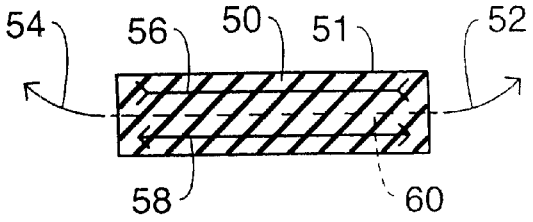
FIG. 1A is a schematic cross-sectional diagram or elevation of a generic elastic block, subject to a bending moment.

In FIG. 1A a cross section of a block 50 of generic elastic material is shown, subject to a moment, represented by curved arrows 52, 54, tending to bend the block around an axis (not shown) perpendicular to a plane of the paper and lying above an upper surface 51. In this context, it should be noted that "elastic" calls our attention to the idea that we are regarding the block as a uniform piece of material with respect to the laws of elasticity, rather than as a member of any particular class of materials, such as the elastomers. In the present invention, however, an elastomeric, or rubber-like, compound will be used for fabrication of an outersole 120 (FIG. 3); in particular, a composition of Thermo Plastic Rubber (TPR) or (natural) rubber.

Figure 1B:
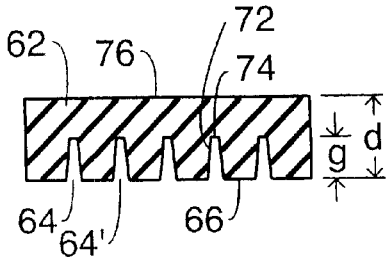
FIG. 1B is a cross-section of the a block modified from that of FIG. 1A, showing removal of material in grooves.
Figure 1C:
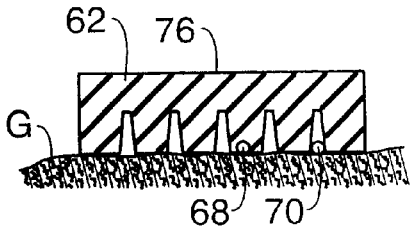
FIG. 1C is a second view of the cross-section of FIG. 1B, showing an interaction with irregularities in a ground surface.
Figure 1D:
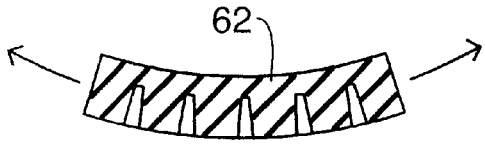
FIG. 1D is a further schematic diagram of the block of FIG. 1B, subject to a bending moment.

As is well known, in a block subject to such a bending, a compressive stress, indicated by double-tailed arrow 56 and a tensile stress, indicated by double-headed arrow 58, are set up in regions approximately bisected by a central plane 60, as further shown in FIG. 1A. Any modification to block 50 tending to reduce stresses represented by arrows 56, 58 will result in a larger deflection (not shown) of the block in response to a given bending moment, and hence in a lower stiffness or enhanced flexibility. A modification to an elastic block as adumbrated above is shown in FIG. 1B. A series of stress-relief notches or grooves 64, 64' et alia are cut into a surface 66 of block 62; a remaining surface of block 62 is thereby partitioned into a plurality of lands (not separately designated) or treads. It can be appreciated for purposes of application of block 62 as an outersole of a shoe (not shown), whereby surface 66 serves as a bottom or exterior surface of an outersole, that an ability of block 62 to absorb and redistribute stresses resulting from contact with irregularities, such as pebbles, 68, 70 protruding from a ground surface G, is either not substantially reduced or in fact increased by introduction of grooves 64, 64' et alia. Irregularity 68 for example lying under a land or tread surface (not designated) meets an unimpaired thickness d of, in the present context, an elastomeric material, which thickness is indeed better able to deform into surrounding grooves than an equivalent volume in a monolithic material. Irregularity 70 on the other hand lying within a groove (not designated) is seen to cause no deformation of block 62. Generally, only an obstacle or irregularity intersecting a wall 72 or floor (ceiling) 74 (FIG. 1B) of a groove may cause a larger deformation of an upper surface 76 of a grooved block 62 than would be caused in solid block 50 by an equivalent irregularity. Grooves 64, 64' et alia do on the other hand clearly relieve tensile stresses of a nature indicated by double-headed arrow 58, and increase flexibility in response to bending moments of a nature represented by arrows 52, 54 in FIG. 1A, as illustrated in FIG. 1D.

The following points will be seen to plausibly arise from an elementary consideration of elasticity, or the strength of materials, in connection with structures similar to those of the present invention (reference may be made to FIG. 2):

a) given a first sequence of parallel grooves 102, 102', 102" cut into an elastic slab 100, a stiffness in bending about an adjacent parallel axis 104 will increase as axis 104 is displaced towards increasing spacing of the first sequence of grooves (i.e., in a direction X); similarly b) given a second sequence of parallel grooves 106, 106', 106" cut into elastic slab 100, perpendicular to first sequence, a stiffness in bending about an adjacent parallel axis 108 will increase as axis 108 is displaced towards increasing spacing of the second sequence of grooves; and c) for small displacements, a bending about an oblique axis 110, lying in a plane spanned by axes 104 and 108, may be approximately decomposed into bendings about axes parallel to axis 104 and axis 108, and a material response be predicted from a local stiffness as a function of an adjacent spacing of grooves parallel to axis 104 and grooves parallel axis 108.

Figure 3:
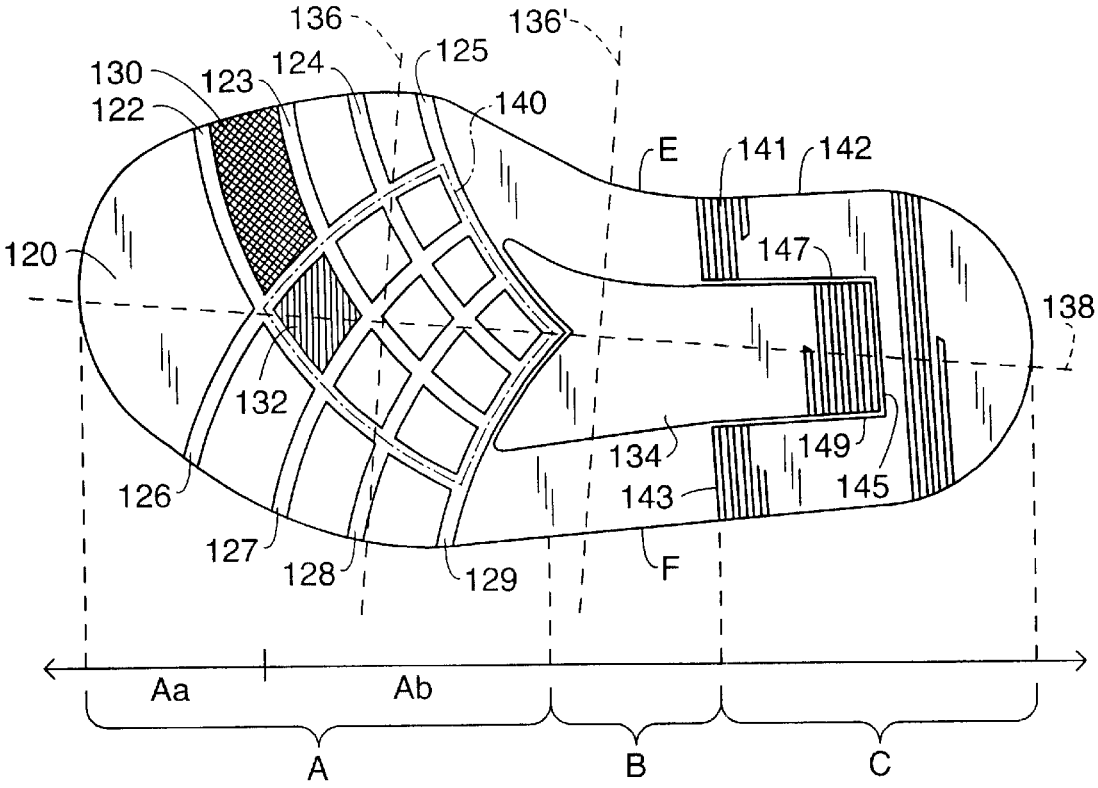
FIG. 3 is a plan view of a bottom surface of an outersole in accordance with the present invention.

In other words, it is asserted, a local stiffness or modulus resisting bending about an axis parallel to a surface of an elastic, or more particularly, an elastomeric slab, may approximately controlled in two independent directions by a spacing or linear density of locally perpendicular stress-relief grooves. Reference will now be made to FIG. 3 in comprehending application of these principles to the present invention.

A shoe outersole 120 composed of an elastormeric, or rubber-like, material. Sets of grooves 122, 123, 124, 125 and 126, 127, 128, 129 start at opposite lateral edges E, F respectively of outersole 120. It may be observed that sets 122–125 and 126–129 maintain substantially parallel, and slightly converging, orientations, terminating on a rear or heelmost element of an opposing set of indentations, so that grooves 122 et alia terminate on groove 129, while grooves 126 et alia terminate on groove 125; generally the grooves are curvilinear or arcuate in form, and particular families of curves of smoothly varying curvature, such as paraboli or hyperboli, for ease in achieving a simple and aesthetic product design.

Heel-most grooves 125, 129 together form a substantially V-shaped groove or indentation, having an apex, as may be understood from consultation of FIG. 3. This apical rearmost groove demarks a boundary of a foresole region A of outersole 120, simultaneously comprising a forward boundary of a bridge or metatarsal support 134, which support includes a V-shaped cutout, receiving the apex. The bridge element or support, in one embodiment, also extends into a heel 142 of outersole 120, which arrangement increases strength of the outersole, by eliminating a joint which might otherwise open up at a forward boundary 143 of the heel, relieving stress by simultaneously moving a frontal surface 145 of a heel-support joint (not separately designated) to a less flexible, central, portion of the heel, and extending the joint with lateral faces 147, 149.

Outersole lands (not separately designated) formed in interstices of grooves 122, 126 et alia are decorated or finished with surface patterns or micro-treads 130, 132 et alia (not shown) in order to improve sole traction, and give the product a finished and aesthetically pleasing appearance. Foresole A further comprises a forward, or toe region, Aa, and a rearward grooved or grid region Ab, while the metatarsal support spans an arch region B of the outersole. A final rearward or heel region C completes a gross geography of the outersole.

Figure 2:
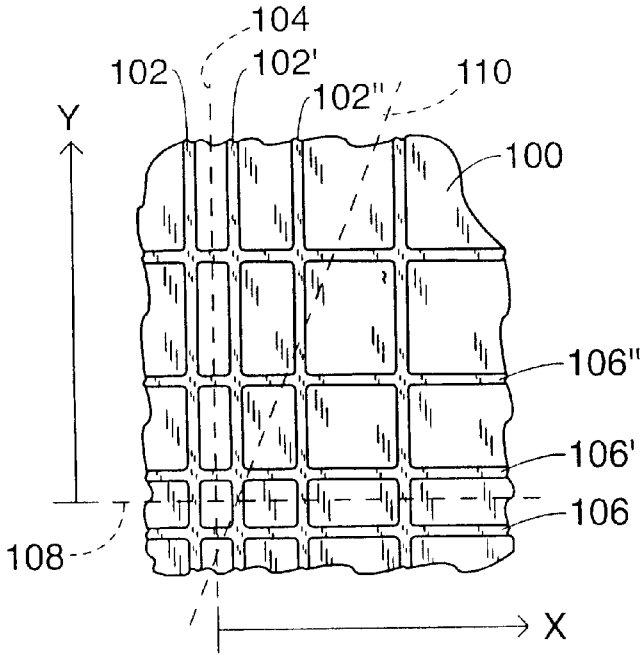
FIG. 2 is a generic diagram of an indented or grooved elastomeric sheet.

It will be appreciated in light of discussion accompanying FIG. 2 that a curvilinear diamond or grid pattern 140 formed by grooves sets 122–125 and 126–129 in the foresole region, together with extensions of either groove set to lateral edges E, F, results in significant variations in stiffness with varying position in the forsole, these variations having substantially independent components about two major axes of bending. It is believed that the particular two-component/two-dimensional variation achieved confers a novel utility on the present invention.

In particular, extensions of grooves 122 et alia and 126 et alia to the lateral edges confer a first added flexibility about a frontal axis 136 in proximity to the edges. However, it will be apparent from the above discussion that in a region of the diamond pattern 140 an added flexibility about axis 136 is taken up equally by grooves at approximately a 45 degree angle to the axis, so that the first added flexibility in maintained essentially constant from edge to edge in a region of the diamond pattern and a lateral extension (not separately designated) thereof. However, it will likewise be apparent that a second added flexibility about a longitudinal or sagittal axis 138 is created in the same region of the diamond pattern, and that this second flexibility is confined largely to a centroid (not separately designated) of the foresole. It may thus be appreciated that an advantageous flexibility is maintained corresponding to a phalangeal movement, or upward flexure of the toes, and to pronating and supinating movements, or rolling of a sole of the foot inwardly and outwardly about longitudinal axis 138 respectively, but, that this flexibility is confined to a centroid of the foresole, avoiding an edge rolling or bending flexure parallel to and in a vicinity of the lateral edges of the outersole. By these considerations a normal and necessary degree of pronation and supination is facilitated, while an excessive and generally deleterious degree of these motions is restrained.

A relative depth of grooves 122, 126 et alia and outersole 120 is also a substantive feature of the present invention. As shown schematically in FIG. 1B, an outersole has a total thickness d, and a groove depth g<d. In one embodiment of the present invention, in a ball region, or vicinity of axis 136, the outersole has a thickness d=7 mm and a groove depth g=5 mm. Thus a remaining, uncut, thickness of outersole amount to only 2 mm. Thus, in light of discussion surrounding FIGS. 1A–1D, it may be appreciated that a flexibility or stiffness of the outersole to bending about axis 126 is governed by a dimensions of 2 mm, while a cushioning and distribution of stress from irregularities in a ground surface is governed by a material dimension of d=7 mm.

Figure 5A:
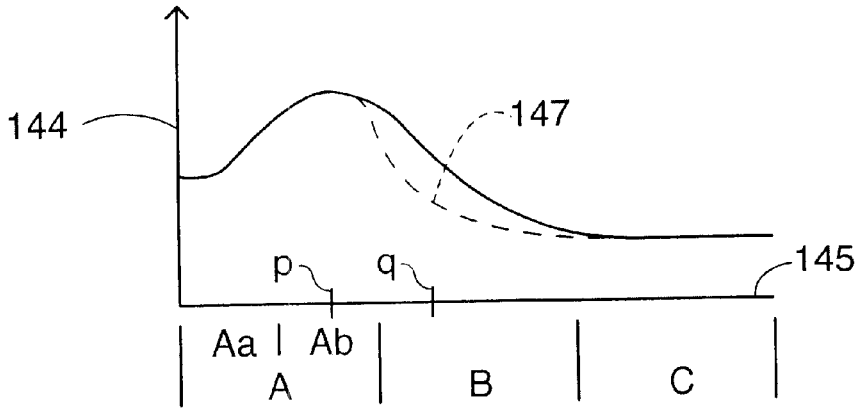
FIG. 5A is a graph showing variation of flexibility about a frontal axis along a longitudinal axis of an outersole.

It may be readily apprehended that a degree of flexibility about frontal axis 136 and parallel translations thereof in a (drawing) plane of FIG. 3 decreases in a heelward direction as bridge 134, also known as a shank support, is encountered, and further as heel 142 is met, as will be appreciated from an inspection of FIG. 5A. In prior art, a steel shank support (not shown) will be utilized internal to a composite sole construction, rather than external elastomeric support or bridge 134. The internal steel shank support will result in a sharper fall of flexibility in a shank or metatarsal region of the shoe, as shown by a dashed curve 147 in FIG. 5A. External support 134 thus provides more gradual variation and better design control of elastic properties of an outersole over a length of longitudinal axis 138, then is allowed by prior art.

FIG. 5A shows a schematic graph of flexibility or degree of deformation for a fixed system of applied forces (not illustrated) about a frontal axis 136 as varying along a longitudinal axis 138 for outersole 142. Flexibility, or inverse stiffness, is a measure of degree of deformation of a structure in response to a given system of forces, in this case, a system tending to bend outersole 120 around frontal axis 136 and parallel displacements thereof; flexibility is shown increasing along a vertical graph axis 144 in FIG. 5A. It will be appreciated that a moderate degree of flexibility in a toe region Aa, or foremost section of foresole A, reaches a maximum at a point p, corresponding roughly to a position of axis 136, in a rearward or grid region Ab of the foresole, as shown along a horizontal graph axis 145. In arch region B an increasing thickness of metatarsal support 134, in particular in taper region 144, results in a decrease in flexibility, passing through a point q corresponding towards a low plateau value in heel region C.

Figure 5B:
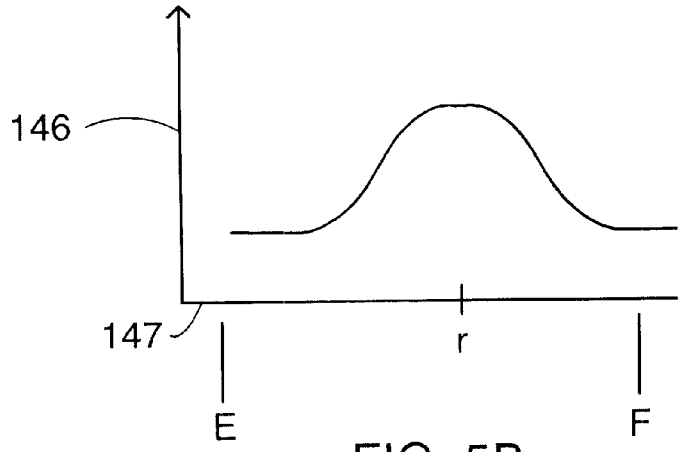
FIG. 5B is a graph showing variation of flexibility about a longitudinal axis along a first frontal axis of an outersole.
Figure 5C:
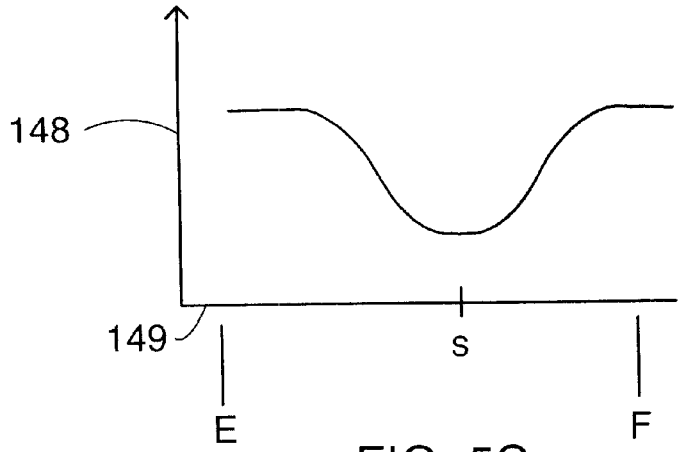
FIG. 5C is a graph showing variation of flexibility about a longitudinal axis along a second frontal axis of an outersole.

Flexibility about longitudinal axis 138 in a vicinity of frontal axes 136 and 136' is graphed in FIGS. 5B and 5C respectively. As shown in FIG. 5B, longitudinal flexibility, measured along frontal axis 136 and shown increasing along a vertical graph axis 146, is at a relative minimum at lateral edges E and F, passes through a maximum at a point r, corresponding roughly to a center line or longitudinal axis 138. In contrast, longitudinal flexibility as varying across frontal axis 136, passing through bridge or metatarsal support 134, is at a relative maximum at points corresponding to lateral edges E and F, and passes through a minimum at a point s, approximately corresponding to a location of center line or longitudinal axis 138.

Figure 4:
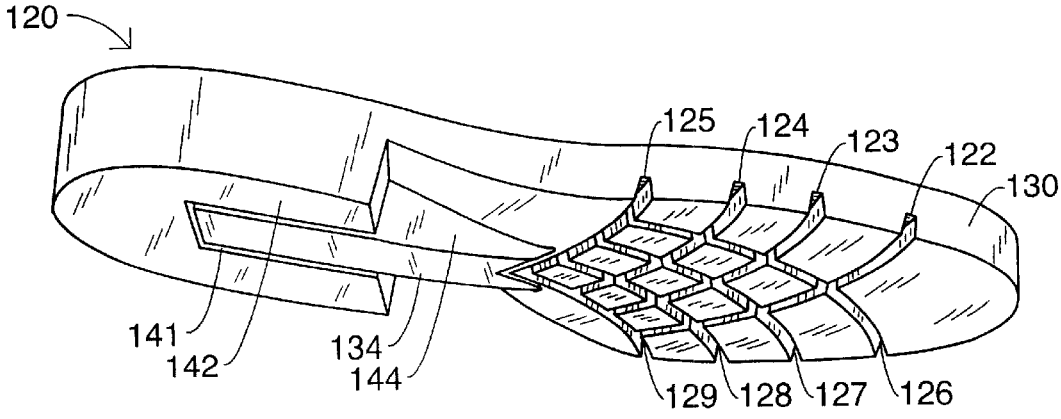
FIG. 4 is a schematic perspective view of the outersole of FIG. 2.

FIG. 4 shows a schematic perspective view of the outersole of FIG. 3, showing a conformation of grooves 122, 126 et alia, and a taper or wedge region 144 of bridge 134, and permitting a general comprehension of features of the outersole. It may also be added that a principal embodiment of the invention utilizes TPR giving a hardness of 50–55 degrees in a forepart, or regions A and B, of the outersole, softer than a typical standard of greater than 55 degrees hardness in the industry, as will be understood by those schooled in the art.

Figure 6B:
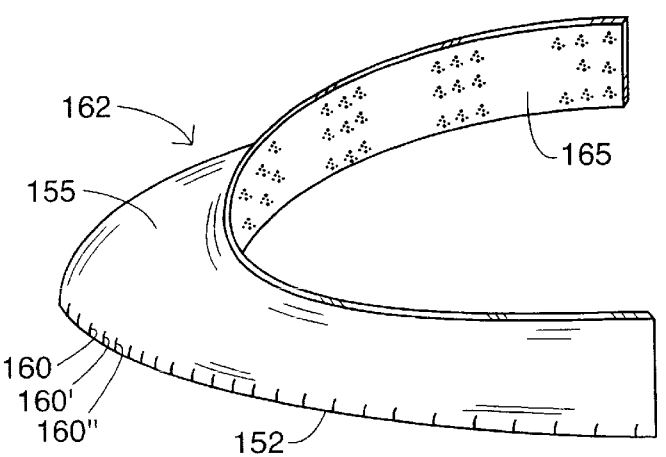
FIG. 6B is an illustration of a first stage preform fabricated from the blank of FIG. 6A.
Figure 6A:
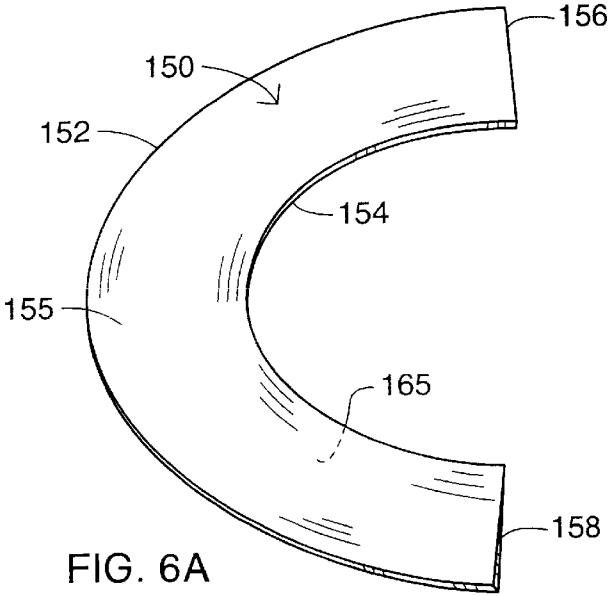
FIG. 6A is a perspective of a blank for use in a construction method in accordance with a feature of the present invention.
Figure 7:
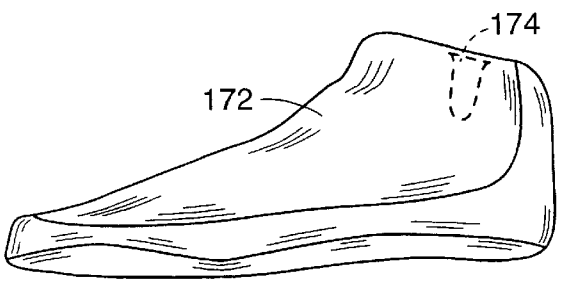
FIG. 7 is an illustration of a last on which the perform of FIG. 6C is mounted.
Figure 6C:
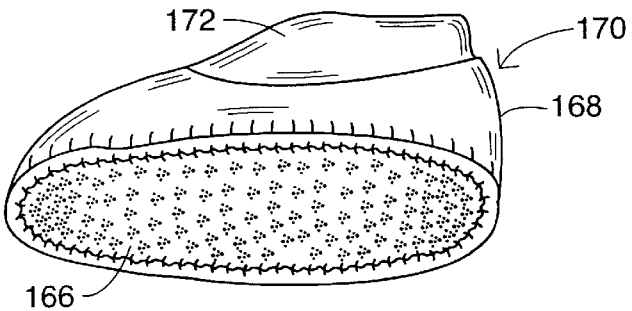
FIG. 6C is an illustration of a second stage preform, or substantially completed upper, fabricated from the preform of FIG. 6B and a midsole.

FIG. 6A illustrates a flat blank 150, which is cut from a sheet of Thermo Plastic Rubber (TPR), for use in making an upper portion of a shoe. Blank 150 has a first or outer edge 152, a second or inner edge 154, and rear-seam edges 156, 158, as well as an outer surface 155 and an inner surface 165. In a first forming operation (not illustrated) blank 150 is manufactured into a first-stage preform 162 by means of a special use sewing machine, known in the art as a Cap Beat Crease Machine (not shown). The Crease Machine, in the control of a skilled operator, creates a series of small creases or crimps 160, 160', 160" et alia, tending to contract or draw together outer edge 152 of blank 150. Blank 150 is thereby distorted into partially convex preform 162, as illustrated in FIG. 6B. In order to complete formation of an upper, a second special use sewing machine (not illustrated), known in the art as a Disc Feed Overseaming machine (not shown), is employed to join a non-woven fabric midsole or insole to the first-stage preform by stitching, in order to form a second-stage preform 170, an item shown in FIG. 6C. Contemporaneously with this stage of processing a rear seam 168 is sewn, joining rear-seam edges, and the preform is mounted on a rigid thermoplastic form 172, or last. The last is shown in isolation in FIG. 7, illustrating that a similarity in form to a human foot, and an inclusion of a post or mounting hole 174, to facilitate handling of the second-stage preform.

Preform 170 is now essentially a fully formed upper, but must be subjected to further processing to relieve stresses and imbue the upper with a permanent shape of a finished shoe. In a first step of a thermal processing stage, the preform is subjected to a 100 to 110 degree centigrade vulcanizing treatment, which removes residual stresses, or a "shape-memory" of a prior flat form of blank 150. Subsequently to the vulcanizing treatment material of the preform or new upper is subjected to a controlled chilling in a second step of thermal processing. The controlled chilling sets the material in a new shape or conformation of a shoe upper. Following the second step of thermal processing, preform, now upper, 170, is ready for final affixement to outersole 120 in a bonding operation. A substantially uniform layer of adhesive is interposed between upper 170 and outersole 120, the upper and outersole subsequently joined and held together until a curing of the adhesive. A layer of open weave or net fabric (not shown) may be interposed between upper 170 and outersole 120 to improve adhesion and reinforce cured adhesive via a fiber reinforcing principle.

The bonding operation substantially completes structural assembly of the shoe, leaving only non-structural items such as an innersole, or insert, and ornamentation such as buckles or straps, which do not significantly alter structural characteristics of the footwear.

What is claimed is:

1. A shoe sole comprising:

a heel;

a foresole indented on a lower surface with a first set of substantially parallel grooves and a second set of substantially parallel grooves, grooves of said first set intersecting grooves of said second set at a substantially constant angle, grooves of said first set terminating at one end on a first lateral edge of said sole and at an other end on a heel-most groove of said second set, grooves of said second set terminating at one end on a second lateral edge of said sole and at an other end on a heelmost groove of said first set;

an instep portion connecting said heel to said foresole.

2. The shoe sole set forth in claim 1 wherein said first grooves and said second grooves are arcuate grooves.

3. The shoe sole set forth in claim 2 wherein said first grooves and said second grooves have a substantially parabolic form.

4. The shoe sole set forth in claim 3 wherein said heel-most groove of said first set and said heel-most groove of said first set define a substantially V-shaped apex, further comprising a bridge element contiguous with and attached to said instep portion, said bridge element having a V-shaped cutout receiving said apex.

5. The shoe sole set forth in claim 4 wherein said bridge element extends into a recess in said heel, a rear end of said bridge element being integrally connected to said heel.

6. The shoe sole set forth in claim 1, further comprising a bridge element contiguous with and attached to said instep portion, a forward end of said bridge element being adjacent to said heelmost groove of said first set and said heel-most groove of said first set.

7. The shoe sole set forth in claim 6 wherein said bridge element extends into a recess in said heel, a rear end of said bridge element being integrally connected to said heel.

8. The shoe sole set forth in claim 1 wherein said first grooves and said second grooves intersect at a plurality of junctions, said junctions being located in a generally diamond-shaped area in a central portion of said foresole.

9. A shoe sole comprising:

a foresole provided on a lower surface with a plurality of intersecting grooves including a rearmost groove having a substantially V shape;

a heel;

an instep portion connecting said heel to said foresole; and a brace or bridge element contiguous with and projecting downwardly from a lower side of said instep portion, said brace or bridge element extending from said heel to said rearmost groove, said brace or bridge element being formed at a forward end with a V-shaped cutout, said rearmost groove extending into said cutout.

10. The shoe sole defined in claim 9 wherein said heel is provided with a recess, said brace or bridge element extending into said recess.

11. The shoe sole defined in claim 9 wherein said brace or bridge element is integrally connected to said instep portion and said heel.

12. A shoe sole comprising:

a foresole provided on a lower surface with a plurality of intersecting grooves including a rearmost groove;

a heel provided with a recess;

an instep portion connecting said heel to said foresole; and a brace or bridge element contiguous with and projecting downwardly from a lower side of said instep portion, said brace or bridge element extending from said heel to said rearmost groove, said brace or bridge element extending into said recess.

13. The shoe sole defined in claim 12 wherein said brace or bridge element is integrally connected to said instep portion and said heel.

* * * * *